US007394369B2

(12) United States Patent
Horngren

(10) Patent No.: US 7,394,369 B2
(45) Date of Patent: Jul. 1, 2008

(54) ANTI-THEFT BOX

(75) Inventor: Tobias Horngren, Staffanstorp (SE)

(73) Assignee: MW Security AB, Malmö (SE)

( * ) Notice: Subject to any disclaimer, the term of this patent is extended or adjusted under 35 U.S.C. 154(b) by 179 days.

(21) Appl. No.: 11/307,135

(22) Filed: Jan. 25, 2006

(65) Prior Publication Data

US 2006/0196780 A1 Sep. 7, 2006

Related U.S. Application Data

(60) Provisional application No. 60/593,581, filed on Jan. 27, 2005.

(30) Foreign Application Priority Data

Jan. 27, 2005 (SE) ..... 0500212

(51) Int. Cl.
*G08B 13/08* (2006.01)

(52) U.S. Cl. ..... 340/545.6; 340/542; 340/568.1; 340/571; 206/1.5

(58) Field of Classification Search ..... 340/545.6, 340/540, 542, 546, 568.1, 571; 206/1.5; 70/58, 64, 160

See application file for complete search history.

(56) References Cited

U.S. PATENT DOCUMENTS

| | | | | |
|---|---|---|---|---|
| 4,591,835 | A * | 5/1986 | Sharp | 340/574 |
| 5,760,689 | A * | 6/1998 | Holmgren | 340/568.8 |
| 6,133,842 | A * | 10/2000 | Gariepy | 340/689 |
| 6,412,633 | B1 * | 7/2002 | Costa | 206/459.5 |
| 2003/0122670 | A1 * | 7/2003 | Stern et al. | 340/568.1 |
| 2005/0195101 | A1 * | 9/2005 | Stevens et al. | 342/28 |

* cited by examiner

*Primary Examiner*—Toan N Pham
(74) *Attorney, Agent, or Firm*—Albihns AB

(57) ABSTRACT

An anti-theft box (100) for protection of goods comprises a main body (110) defining an inner space for the goods to be protected, a lid (120) closing said main body (110), an alarm transmitter triggering a central alarm in case the anti-theft box (100) passes an alarm gate, and a releasable lock (140 145, 150, 160) locking the lid (120) to the main body (110). The anti-theft box according to the invention also comprises an internal alarm circuit (200) that is controlled to be fused when the releasable lock (140 145, 150, 160) is in a locking position and defused when the releasable lock (140 145, 150, 160) is in an unlocked position. The internal alarm circuit (200) comprises a first switch (210), which in the fused state is arranged to trigger the alarm circuit to emit a sound signal in case the first switch (210) indicates that the lid (120) and the main body (110) are separated.

6 Claims, 3 Drawing Sheets

100
120
160
220
145
200
180
230
190
140
210
170
150
110

190
160
100
120
130
170
240
110

ANTI-THEFT BOX

FIELD OF THE INVENTION

The present invention relates to an anti-theft box for protection of goods. The anti-theft box comprises a main body defining an inner space for the goods to be protected, a lid closing said main body, an alarm transmitter triggering a secondary alarm in case the anti-theft box passes an alarm gate, and a releasable lock locking the lid to the main body.

PRIOR ART

It is a well known technique to anti-theft protect goods on sale in e.g. stores, warehouses or supermarkets by packing the goods in transparent alarm boxes which can be closed and locked. The boxes each comprises an alarm transmitter that triggers a central store alarm if a person in the store attempts to bring the box outside a restricted area defined by alarm gates. When the goods have been paid for, the cashier personnel will open the box with a specially designed key and take out the goods that was stored and protected in the box, after which the customer safely can bring the goods outside the restricted area, without triggering the central store alarm.

The fact that the boxes are transparent helps the costumer getting a feeling for the product, since it can be viewed from different directions. This feature has proven to be very important from a sales perspective, although the protection of the product in no way is enhanced.

PROBLEM WITH THE PRIOR ART

An obvious problem with the prior art anti-theft boxes is that a shoplifter might attempt to open the box without access to the proper key; experience has shown that the most common way to open an anti-theft box is to insert a screwdriver or the like between the lid and the main body and force the lid open.

Another common way to illegitimately open the box is to use a cutting tool and cut off the hinges joining the lid and the main body. After the hinges have been cut off, the lid can be separated from the main body, and the goods inside the main body can be accessed.

Taken the above, it is an object of the present invention to solve the problem with shoplifters illegitimately opening anti-theft boxes containing goods to be protected.

SUMMARY OF THE INVENTION

The above-identified problem is solved by an internal alarm circuit that is controlled to be fused when a releasable lock is in a locking position and defused when the releasable lock is in an unlocked position, said internal alarm circuit comprising a switch between the main body and the lid, which in the fused state is arranged to trigger the alarm circuit to emit a sound signal in case the switch between the main body and the lid indicates that the lid and the main body are separated.

Due to design criteria, it is preferred if the alarm circuit is connected to a second switch indicating whether the lock is in a locked position.

In order to avoid shoplifters turning off the sound signal immediately upon triggering, it is preferred if there is provided a timing circuit in the alarm circuit, the timing circuit sounding the siren for a predetermined period of time as soon as the alarm circuit has been triggered.

For deterring shoplifters by warning them for the alarm circuit, an advantageous embodiment of the anti-theft box comprises a diode lamp indicating whether the alarm circuit is fused.

For simplicity of design, it is advantageous if a first switch indicating the position of the releasable lock is arranged to fuse the alarm circuit.

Because of the high sound level, the cost effectiveness and the compactness, it is preferred if the sound signal is produced by a piezo-electric type siren.

BRIEF DESCRIPTION OF THE DRAWINGS

Hereinafter, the invention will be described with reference to the appended drawings, wherein.

DESCRIPTION OF PREFERRED EMBODIMENTS

Figure 1:
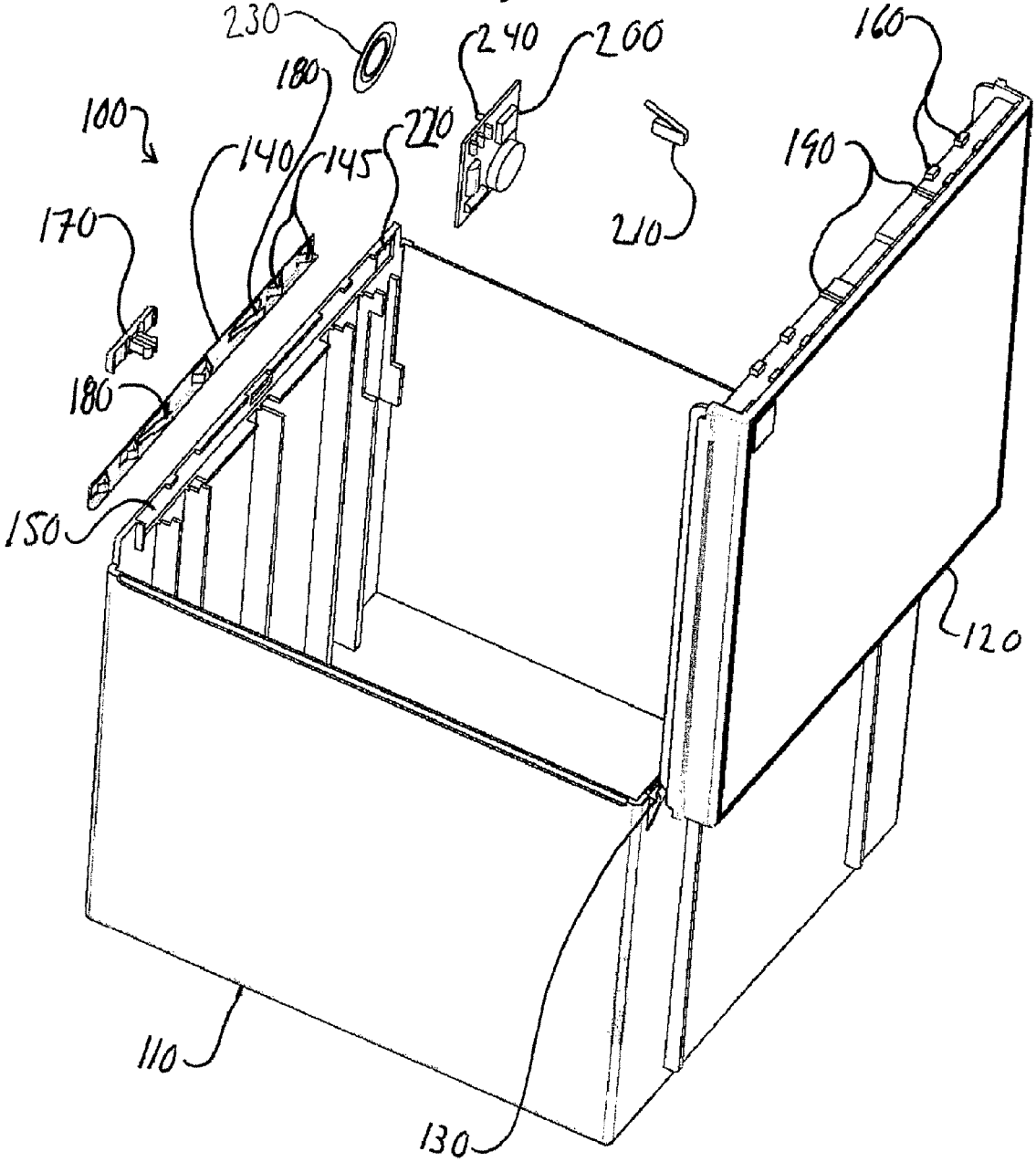
FIG. 1 is an exploded perspective view showing an alarm box according to the invention.
Figure 2:
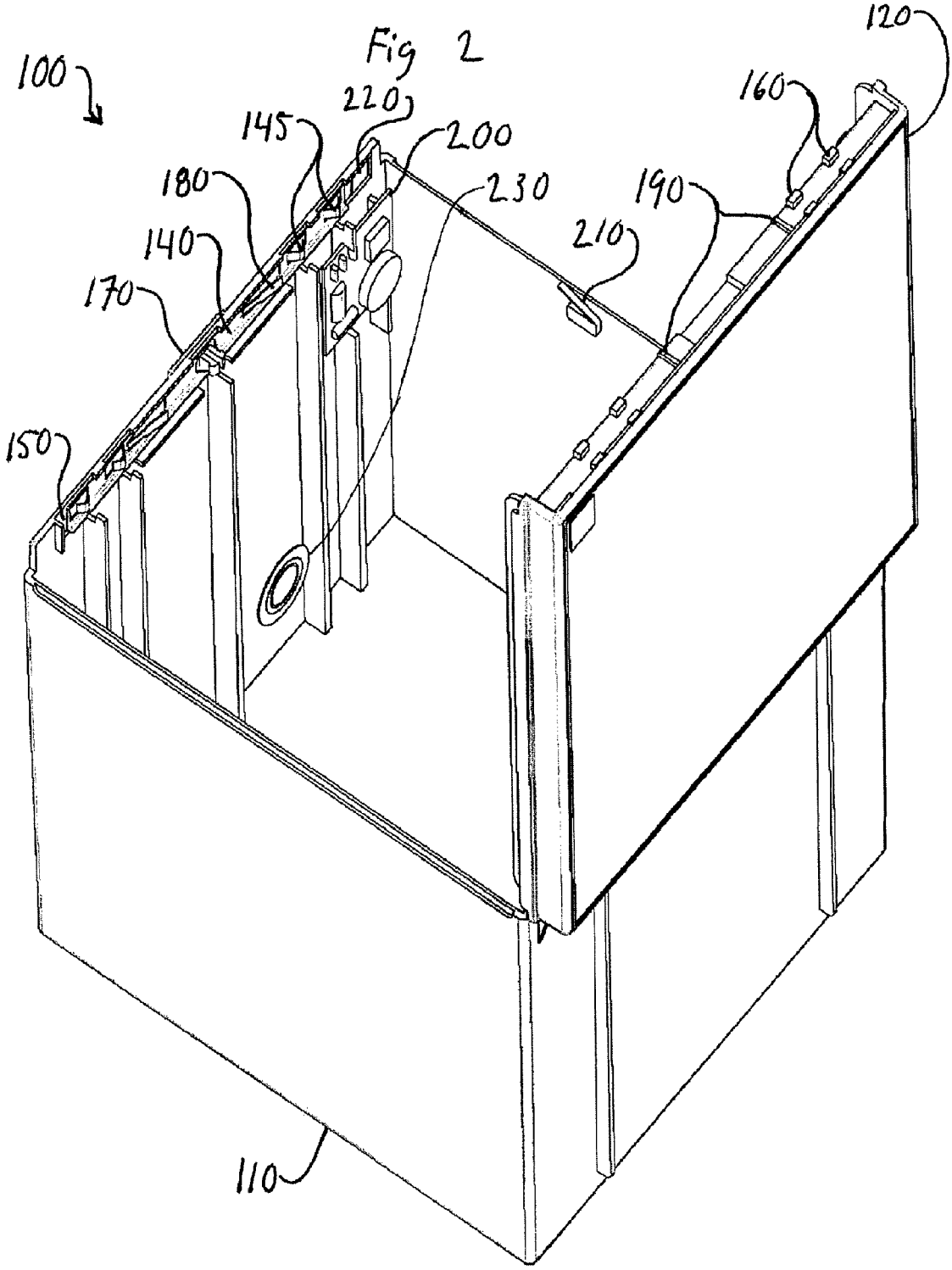
FIG. 2 is an assembled perspective view of the alarm box of FIG. 1
Figure 3:
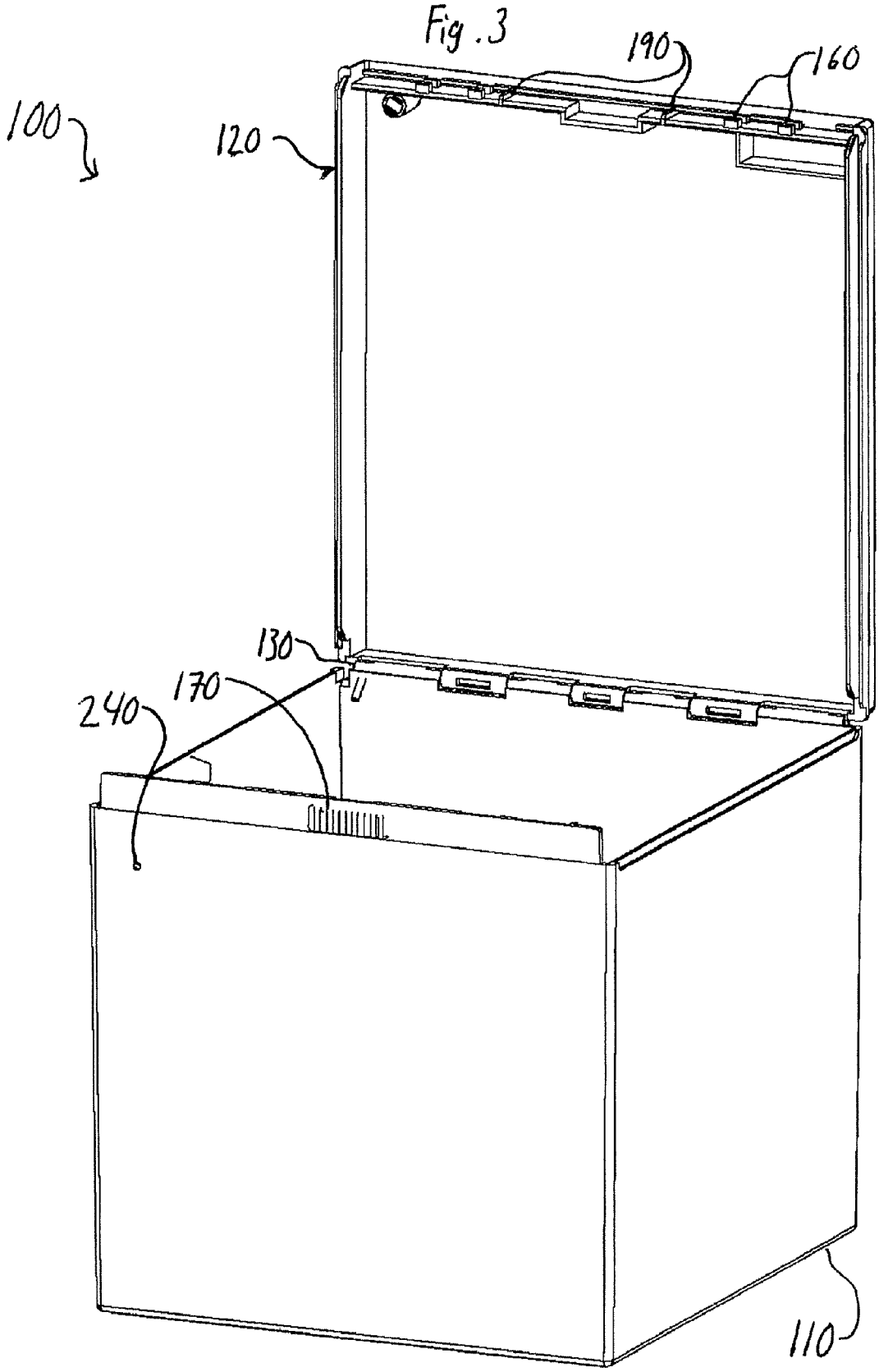
FIG. 3 is a front view of an alarm box comprising a diode lamp indicating whether the alarm box is fused.

In FIGS. 1 to 3, an alarm box 100 according to the present invention is shown. The alarm box 100 comprises a main body 110, a lid 120 and a hinge 130 rotatably connecting one end of the main body 110 and the lid 120. Moreover, the alarm box 100 includes a lock member 140, manufactured from an electrically conductive, magnetic material, and comprising lock means 145 movable along a track 150 provided in a top portion of the main body 110, on a position opposite the hinge 130, wherein the lock means 145 cooperates with lock tabs 160 provided on the lid 120 to lock the lid 120 to the main body 110. The movement of the lock member 140 is controlled by a control knob 170 and by two tongues 180, the tongues cooperating with shoulders 190 provided on the lid 120.

For locking the alarm box 100, the main body 110 and the lid 120 are brought together, whereupon the control knob 170 is moved in a locking direction. This movement forces the tongues 180 to "click" over the shoulders 190 and simultaneously locks the lock tabs 160 by interaction with the lock means 145. To unlock the box, a "magnetic key" comprising two powerful magnets is used; the powerful magnets will retract the tongues 180 from the engagement with the shoulders 190, hence allowing the lock member 140 to be moved into an unlocking position.

The function of the above components does not form any part of the present invention, and is also well described in European patent application 03 077 961.8; hence, the above explanation of the function of said components is rather sparse.

In order to overcome the aforementioned drawback with the alarm box according to the prior art, the alarm box 100 according to the present invention comprises an alarm circuit 200 connected to a first switch 210 for detecting whether the lid 120 is in the closed position, a second switch 220 for detecting whether the lock member 140 is in a locked position, and a siren 230, that might form a part of the alarm circuit 200. Optionally, the alarm circuit 200 may comprise, or be connected to, a diode lamp 240 indicating whether the alarm circuit 200 is fused, i.e. activated to sound an alarm in case the first switch 210 detects opening of the lid 120.

In its simplest form, the alarm circuit 200 will sound the siren 230 in case the first switch 210 indicates that the lid 120 is open and the second switch 220 indicates that the lock member 140 is in a locked position. For this embodiment, there is a risk for unintentional triggering of the alarm; there is nothing that excludes that the lock member 140 is moved to a locking position when the lid 120 is in an open position.

In a second embodiment of the invention, the alarm circuit 200 is designed to trigger only if the following criteria are met;

the second switch 220 should indicate that the lock member 140 is in a locking position, and the first switch 210 should indicate a position change, i.e. a difference in indication from closed to opened.

In this way, the lock member 140 can be moved into a locking position even if the lid 120 is open, without triggering the alarm circuit 200 to sound the siren 230.

For this embodiment, it is advantageous if the alarm circuit 200 comprises a timing function, that sounds the siren for a predetermined time, e.g. 1-30 seconds, e.g. 5-20 seconds, e.g. 10-15 seconds after the alarm circuit 200 has been triggered. By adding a timing function to the alarm circuit of the first embodiment, it can be avoided that an obdurate shoplifter immediately after the alarm circuit has been triggered deactivates the alarm by pressing the first switch 210.

The first switch 210 can comprise a mechanical micro-switch or a magnetic micro switch of the type that comprises a switch unit and a permanent magnet; in case the permanent magnet moves away from the switch unit, the switch unit will indicate this. A preferred solution should be to fasten the permanent magnet to the lid 120, and the switch unit to the main body 110.

Regarding the second switch 220, this switch preferably comprises a simple tongue of an electrically conducting material provided close to an end of the locking member 140, wherein the locking member 140 is electrically connected to one end of an electrical circuit fusing the alarm circuit 200 and the tongue to the other end of said electrical curcuit; as the locking member is moved to a locking position, the tongue and the locking member will contact one another, hence closing the electrical circuit and fusing the alarm circuit.

The siren (230) is preferably of the piezo-electric type; such sirens have a very high sound level, they are compact, and they are cost-efficient. In order to increase the emitted sound level from the siren, there is provided an opening through the main body wall. This opening has preferably a size, and is preferably designed, so that it is difficult to block the opening by e.g. a finger.

The invention could also be used for other alarm device configurations than a box; one example of such a configuration is a first body being hinge connected to a second body, wherein said bodies in a closed position will define a space for locking onto an elongate object to be protected, e.g. a bottle neck.

Of course, there are several modifications possible within the scope of the present invention. Not all such modifications are mentioned here; the scope of the invention is only limited by the features of the appended claims.

What is claimed is:

1. Anti-theft box for protection of goods, the anti-theft box comprising:

a) a main body defining an inner space for the goods to be protected, b) a lid closing said main body, c) an alarm transmitter for triggering a central alarm in case the anti-theft box passes an alarm gate, d) a releasable lock for locking the lid to the main body, e) and an internal alarm circuit that is controlled to be fused when the releasable lock is in a locking position and defused when the releasable lock is in an unlocked position, said internal alarm circuit comprising a first switch, which in the fused state is arranged to trigger the internal alarm circuit to emit a sound signal in case the first switch indicates that the lid and the main body are separated.

2. The anti-theft box of claim 1, wherein the internal alarm circuit is connected to a second switch indicating whether the lock is in a locked position.

3. The anti-theft box of claim 2, wherein the second switch indicating the position of the releasable lock is arranged to fuse the internal alarm circuit.

4. The anti-theft box of claim 1, wherein there is provided a timing circuit in the internal alarm circuit, the timing circuit sounding the siren for a predetermined period of time as soon as the alarm circuit has been triggered.

5. The anti-theft box according to claim 1, wherein a diode lamp indicates whether the internal alarm circuit is fused.

6. The anti-theft box of claim 1, wherein the sound signal is produced by a piezo-electric type siren.

* * * * *